US006588874B2

(12) United States Patent
Tsuchiya et al.

(10) Patent No.: US 6,588,874 B2
(45) Date of Patent: Jul. 8, 2003

(54) AIRTIGHT ELASTIC CAP OF INK-JET RECORDING HEAD, STORAGE CONTAINER, AND INK-JET RECORDING APPARATUS

(75) Inventors: Takatoshi Tsuchiya, Ebina (JP); Atsumichi Imazeki, Ebina (JP); Harumi Tamura, Toshima-ku (JP)

(73) Assignee: Fuji Xerox Co., Ltd., Tokyo (JP)

( * ) Notice: Subject to any disclaimer, the term of this patent is extended or adjusted under 35 U.S.C. 154(b) by 1 day.

(21) Appl. No.: 09/909,825

(22) Filed: Jul. 23, 2001

(65) Prior Publication Data

US 2002/0008726 A1 Jan. 24, 2002

(30) Foreign Application Priority Data

Jul. 24, 2000 (JP) ..... 2000-223038
Feb. 2, 2001 (JP) ..... 2001-026799

(51) Int. Cl.[7] ..... B41J 2/165
(52) U.S. Cl. ..... 347/29
(58) Field of Search ..... 347/29, 86, 108; 206/204, 723; 220/784, 795; 53/471

(56) References Cited

U.S. PATENT DOCUMENTS 5,373,936 A * 12/1994 Kawai et al. ..... 206/204
5,717,444 A * 2/1998 Sugimoto et al. ..... 347/29
5,896,143 A * 4/1999 Matsui et al. ..... 347/24

FOREIGN PATENT DOCUMENTS

JP 4-73158 A 3/1992
JP 5-57906 A 3/1993
JP 8-244249 A 9/1996
JP 2724004 B2 11/1997

* cited by examiner

*Primary Examiner*—Shih-wen Hsieh
(74) *Attorney, Agent, or Firm*—Oliff & Berridge, PLC

(57) ABSTRACT

An airtight elastic cap of an ink-jet recording head and a storage container employing the airtight elastic cap provide high airtightness between a nozzle face and the airtight cap and minimizes ink leak from the recording head even when the head is mounted or dismounted, or when a storage environment changes suddenly. The airtight elastic cap includes a body and an inside wall provided inside thereof. A portion of the wall defines a first space and another portion defines a second space positioned continuously to a center of the first space. The storage container includes a container body that houses the ink-jet recording head and the airtight elastic cap, placed within the container body, that abuts against and protects an ink emission face of the ink-jet recording head while the ink-jet recording is housed.

26 Claims, 4 Drawing Sheets

AIRTIGHT ELASTIC CAP OF INK-JET RECORDING HEAD, STORAGE CONTAINER, AND INK-JET RECORDING APPARATUS

BACKGROUND OF THE INVENTION

1. Field of the Invention

The present invention relates to an airtight elastic cap of an ink-jet recording head used in an ink-jet printer or the like. Also, the present invention relates to a storage container for temporarily storing the ink-jet recording head removed from the ink-jet recording printer. Moreover, the present invention relates to an ink-jet recording apparatus having the airtight elastic cap.

2. Description of the Prior Art

According to a known prior art method, by pressing a recording head against an airtight cap by a predetermined amount, ribs provided on a cap face are brought into intimate contact with a nozzle face to obtain airtightness between the nozzle face and the cap face, and prevent the nozzle face from drying. However, there has been a problem in conventional caps in that high airtightness might make air within the caps susceptible to changes in temperature and air pressure, with the result that, when a head is mounted or dismounted, or when a storage environment changes suddenly, air pressure within the caps might change and ink within a nozzle might flow into the caps. To solve this problem, in Japanese Published Unexamined Patent Application No. Hei 5-57906, a method is disclosed for avoiding changes in air pressure by providing elasticity for a cap. However, this method has had a problem in that springs and other parts are required to provide elasticity for the cap, making its structure complicated and increasing the number of parts. On the other hand, in Japanese Published Unexamined Patent Application No. Hei 8-244249, a method is disclosed for avoiding changes in air pressure by providing a cap body with air communication holes to establish communication between a space within the cap and the air. In this case, there is a problem in that, since airtightness between a nozzle face and a cap body cannot be obtained and the nozzle face contacts the air, the nozzle face is liable to get dry. Although, to solve these problems, it is conceivable to increase a space capacity within an airtight cap to such an extent that ink leak does not occur regardless of the above-described changes in air pressure, the mere increase of the space capacity within the cap might decrease the stiffness of the cap itself and reduce cap airtightness.

SUMMARY OF THE INVENTION

The present invention provides an airtight elastic cap of an ink-jet recording head that provides high airtightness between a nozzle face and the airtight cap and minimizes ink leak from the recording head even when the head is mounted or dismounted, or when a storage environment changes suddenly, a storage container of the ink-jet recording head employing the airtight elastic cap, and an ink-jet recording apparatus equipped with the airtight elastic cap.

According to an aspect of the present invention, an airtight elastic cap of an ink-jet recording head includes a body, and an inside wall provided inside of the body. A portion of the wall defines a first space and another portion of the wall defines a second space positioned continuously to a center of the first space.

According to another aspect of the present invention, a storage container of an ink-jet recording head includes a container body that houses the ink-jet recording head, and an airtight elastic cap, placed within the container body, that abuts against and protects an ink emission face of the ink-jet recording head while the ink-jet recording is housed. The airtight elastic cap includes a cap body and an inside wall provided inside of the cap body. A portion of the wall defines a first space and another portion of the wall defines a second space positioned continuously to a center of the first space.

When the ink emission face of the ink-jet recording head abuts against the airtight elastic cap, the ink emission face is protected in airtightness state by a space formed between the ink emission face of the recording head and a wall of the airtight elastic cap body. Since the space part is formed by two space parts, ink leak from a nozzle of the recording head is prevented regardless of changes in air pressure in the space part when the recording head is dismounted, or when air pressure or temperature changes, and the stiffness of the airtight elastic cap body is maintained. Disposing the airtight elastic cap within the storage container facilitates the positioning of the ink emission face of the recording head and the airtight elastic cap when the recording head is stored.

BRIEF DESCRIPTION OF THE DRAWINGS

Preferred embodiments of the present invention will be described in detail based on the followings, wherein.

DESCRIPTION OF THE PREFERRED EMBODIMENTS

Figure 6:
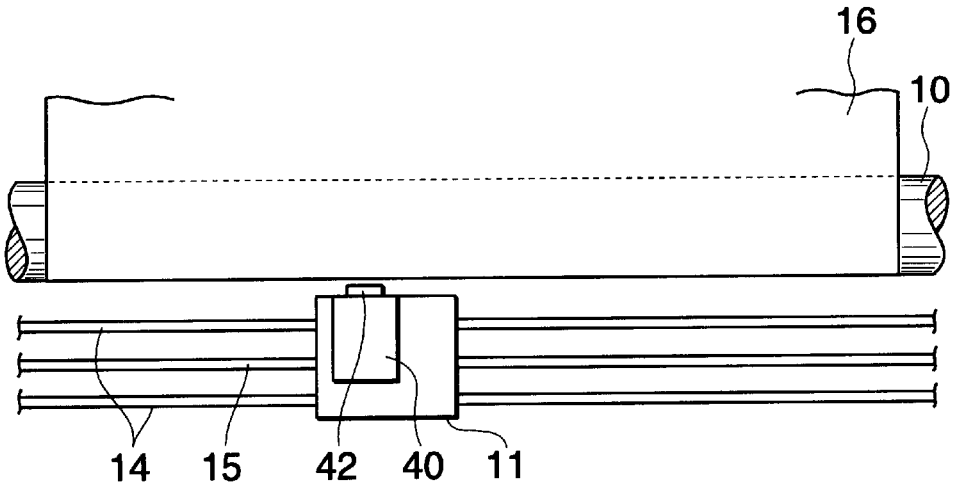
FIG. 6 is a schematic diagram of an ink-jet recording apparatus in and from which the ink-jet recording head according to one embodiment of the present invention is mounted and dismounted.

Hereinafter, the present invention will be described in detail based on illustrated embodiment examples. FIG. 6 is a schematic diagram of a part of an ink-jet printer. A reference numeral 10 in the drawing designates a platen and 11 designates a carriage. The platen 10, which has a cylindrical shape, is supported to side plates of the printer and provided so as to be rotatable by driving from a driving motor not shown. The carriage 11 has an ink-jet recording head 40 in which an ink tank is fixedly mounted or is mounted so as to be freely loadable and unloadable, and a recording head chip 42 of the ink-jet recording head is provided in opposed relation to the platen 10. The carriage 11 is fitted to the guide shaft 14 so as to be able to freely reciprocate and provided so as to be able to freely reciprocate for movement along the platen 10 by a belt 15 run by a driving motor not shown. The reference numeral 16 designates recording paper (sheet).

During use of the printer, an image is formed by emitting ink from the recording head chip 42 of the ink-jet recording head onto recording paper 16 fed on the platen 10 while moving the carriage 11 back and forth along the platen 10.

Figure 3:
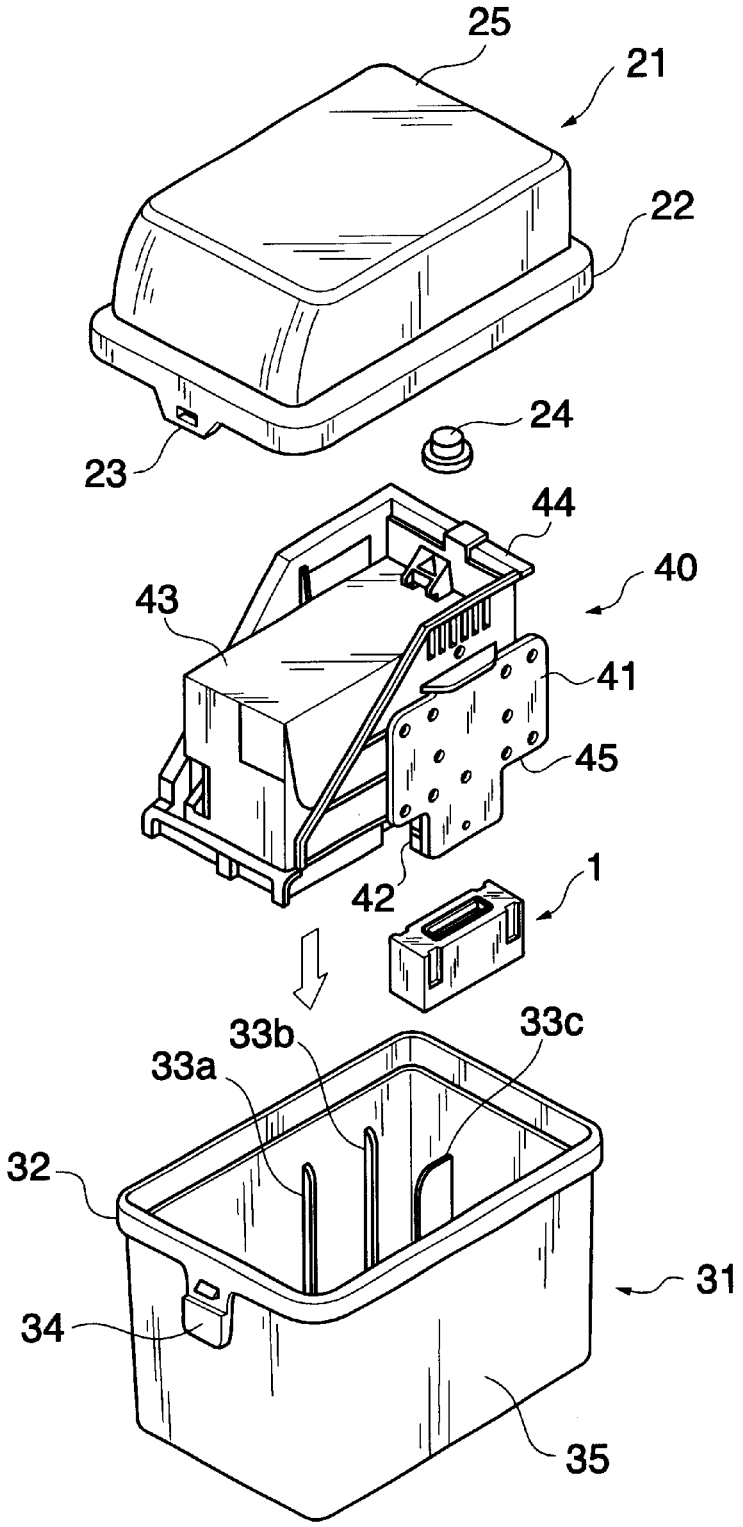
FIG. 3 is an exploded perspective view showing a relationship between a storage container of an ink-jet recording head according to one embodiment of the present invention and the ink-jet recording head.

The ink-jet recording head 40 includes, as shown in FIG. 3, an ink tank housing part 44, an ink tank 43 loaded in the ink tank housing part 44, a recording head chip 42 connected to the ink tank 43, and a heat sink 41 placed adjacent to the recording head chip 42, wherein a large number of ink jet nozzles not shown are arranged at the bottom face of the recording head chip 42.

The ink-jet recording head being used is, as required, replaced by an ink-jet recording head having an ink cartridge of a different color, and stored in the storage container for storage. The storage container, as shown in FIG. 3, includes a first container 31 and a second container 21; in this embodiment example, the first container 31 is formed as a housing part of the ink-jet recording head and the second container 21 is formed as a lid engaged with the housing part. Hereinafter, for convenience, the first container will be represented as a recording head housing part 31 and the second container as a lid 21.

The recording head housing part 31 includes a storage container body 35, an engagement rib 32 provided on the upper end face of the storage container body, and ribs 33*a*, 33*b*, and 33*c*, provided on the inside face of the storage container, for controlling the position of the ink-jet recording head 40 when it is housed. These ribs function as guides for housing the ink-jet recording head 40 in the recording head housing part 31 with accurate positioning when the ink-jet recording head 40 is housed in the recording head housing part 31 in the direction of the arrow (downward). These ribs also have the function to secure the ink-jet recording head 40 within the recording head housing part 31 when the ink-jet recording head 40 has been inserted in the recording head housing part 31. The recording head housing part 31 is provided with an engagement claw 34 integrated with the engagement rib 32. An airtight elastic cap 1 described later is secured within the ink-jet housing part 31.

On the other hand, the lid 21 includes a lid body 25 and a lid engagement rib 22 to be engaged with the engagement rib 32 of the recording head housing part 31, wherein the lid engagement rib 22 is integrated with a tab 23 having an opening. The opening of the tab 23 is engaged with the engagement claw 34 provided in the recording head housing part 31 to secure the lid 21 to the recording head housing part 31. In the storage container of the present invention, since the ink emission face of the ink-jet recording head is airtightly protected by the airtight elastic cap 1 as described later, the storage container body 35 need not be constructed so as to be airtight.

The lid 21 is secured to the recording head housing part 31 so that it turns freely about a hinge not shown. The hinge is structured so as to enable free engagement and disengagement between the lid 21 and the recording head housing part 31.

Figure 4:
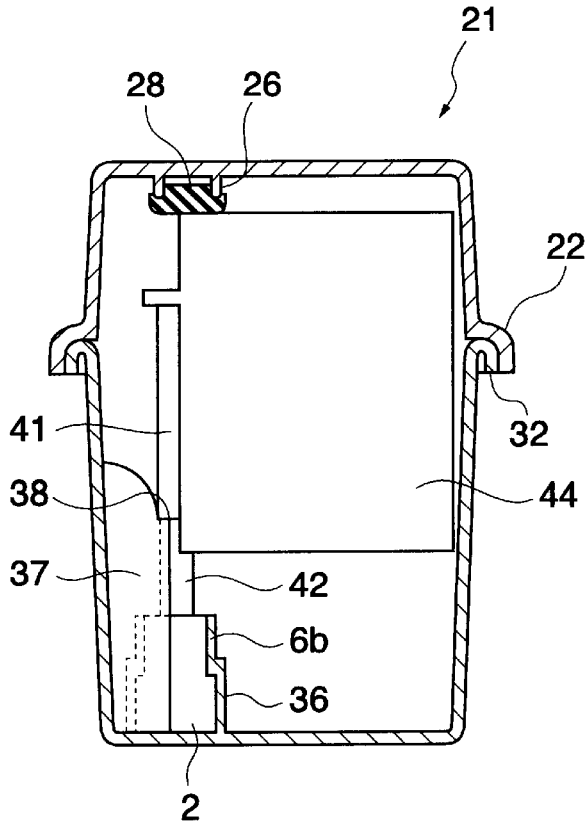
FIG. 4 is a sectional view showing the storage container of the inkjet recording head according to one embodiment of the present invention.

As shown in FIG. 4, inside the lid 21 are provided a circular rib 26 formed by the injection molding method, and an elastic rubber element 28 fitted in the circular rib 26. With the lid 21 closed, the elastic rubber element 28 energizes the upper face of the ink-jet recording head 40 to press the ink emission face of the head chip 42 against the airtight elastic cap 1.

A rib 37 having a stepwise gap 38 is provided on an inside face of the ink-jet recording head housing part 31. When the ink-jet recording head 40 is housed in the recording head housing part 31, the stepwise gap 38 abuts against a stepwise gap in the vicinity of the recording head chip 42 of the ink-jet recording head 40, whereby a clearance or contact state between the ink emission face of the recording head chip 42 and the airtight elastic cap 1 is controlled so as to fall within a predetermined design value range. In this embodiment example, as the stepwise gap of the ink-jet recording head, a stepwise gap 45 of the heat sink 41 provided adjacent to the head chip 42 is used.

Figure 5:
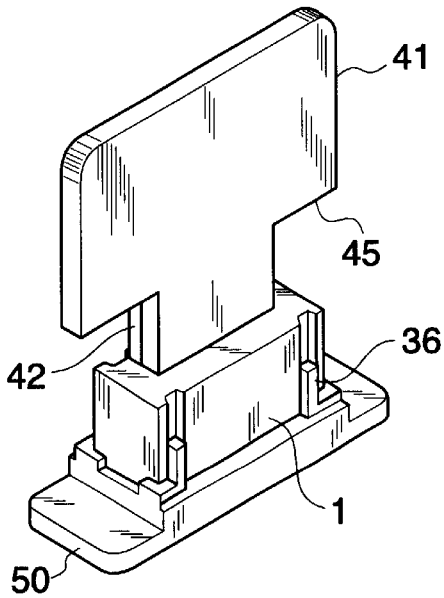
FIG. 5 is a perspective view showing a state of contact between a head chip and the airtight elastic cap.

When the ink-jet recording head 40 has been thus inserted in the recording head housing part, the distance between the ink emission face of the head chip 42 and the airtight elastic cap 1 is roughly determined by the abutting action between the stepwise gap 38 of the rib 37 and the stepwise gap 45 of the heat sink 41. When the lid 21 is closed, the elastic rubber element 28 of the lid 21 energizes the upper end face of the ink tank housing part 44 of the ink-jet recording head 40 so that the lid 21 is secured to the recording head housing part 31. In this state, as shown in FIG. 5, the ink emission face of the recording head chip 42 is pressed against the airtight elastic cap 1 with a predetermined press force so that the ink emission face is airtightly protected. In the above-described storage state, preferably, the above-described press force falls within a range of 350±150 gf.

Figure 1:
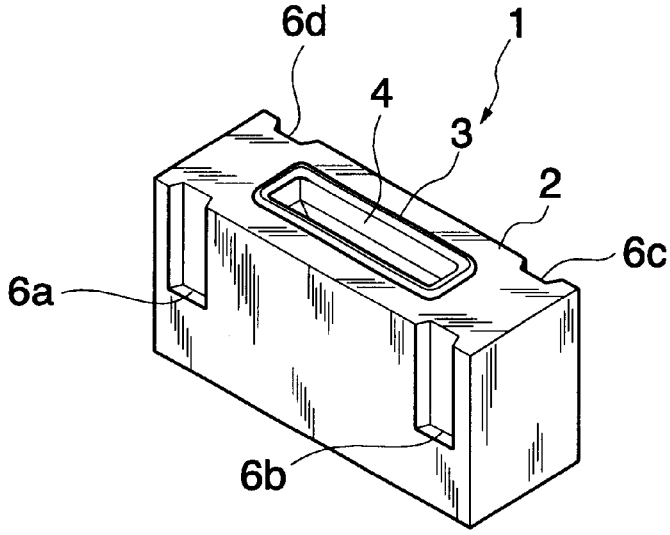
FIG. 1 is a perspective view showing the structure of an airtight elastic cap according to one embodiment of the present invention.
Figure 2:
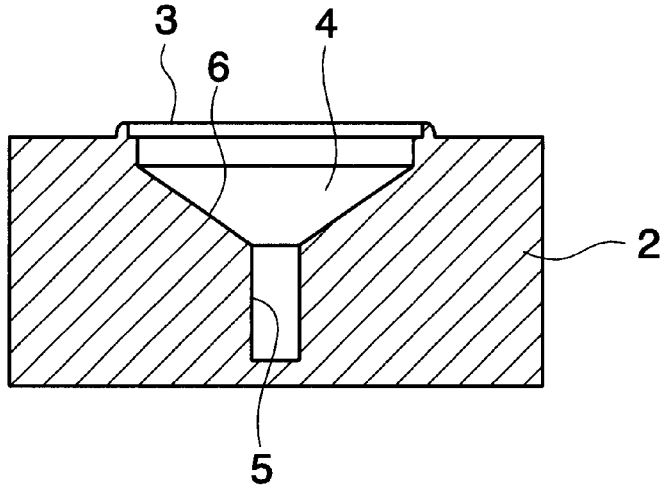
FIG. 2 is a longitudinal sectional view showing the structure of an airtight elastic cap according to one embodiment example of the present invention.

The airtight elastic cap 1, as shown by the perspective view of FIG. 1 and the longitudinal sectional view of FIG. 2, includes an airtight elastic cap body 2, a first space 4 defined by an inside wall face 6 of the airtight elastic cap body 2, and a second space 5 provided continuously to the center of the first space 4. These spaces form a closed space within the airtight elastic cap 1 so that they are airtight in the state in which the airtight elastic cap 1 is abutted against the ink emission face of the ink-jet recording head.

Since space capacity within the airtight elastic cap 1 can be substantially increased by configuring the space of the airtight elastic cap 1 by the first space 4 and the second space 5 continuing to the center of the first space 4, a change in internal pressure caused by a change in the space capacity when the ink-jet recording head 40 is mounted or dismounted, or when pressure or temperature changes can be relatively reduced. Thereby, ink leak from a nozzle of the recording head when the ink-jet recording head is mounted or dismounted can be minimized or prevented.

If internal capacity is increased by the second space 5 continuing to the center of the first space 4, the second space 5 is positioned at approximately the center of the airtight elastic cap body 2. Since there is no space at the side of the airtight elastic cap body, the stiffness of the rubber element required to keep the recording head airtight is not impaired. Namely, since the airtight elastic cap includes a space portion provided at the center thereof, and an elastic body surrounding the space portion, an amount of deformation of the airtight elastic cap 1 upon application of pressure can be relatively reduced. Therefore, the ink emission face of the recording head can be stably kept airtight.

In this embodiment example, the first space 4 is formed as a space defined by an inside face 6 of tapered, inclined wall of the airtight elastic cap body. The second space 5 is formed as a space continuing to the top of the inside face 6 of the inclined wall. With this construction, should ink leak from the nozzle of the ink-jet recording head when the ink-jet recording head is mounted or dismounted, since the leaking ink would be guided to the second space 5 along the inside face 6 of the inclined wall, the inside face 6 of the inclined wall defining the first space 4 would serve as a guiding face of the leaking ink and the second space 5 as an ink sink. Ink absorption supporters may be placed in the first space 4 and the second space 5. The first and second spaces may be formed in any shape.

The airtight elastic cap 1 is provided with an elastic rib 3 on a face thereof abutting against the ink emission face of the ink-jet recording head in a position where the elastic rib 3 does not interfere with the ink emission nozzles on the ink emission face, wherein the elastic rib 3 abuts outside the ink emission nozzles. Although a protrusion height of the elastic rib from the airtight elastic cap body 2 can be arbitrarily set, it is desirably 2 mm or less, or in the range of 0.5 to 1 mm. The height of a press margin with respect to a protrusion height, that is, a permissible amount by which the elastic rib 3 is pressed in when abutted against the ink-jet recording head can be arbitrarily set but is desirably in the range of 40 to 70% or desirably 55 to 65% with respect to a protrusion height.

Although the airtight elastic cap 1 can be made of elastic materials such as plastic and rubber, it should be preferably made of ethylene-propylene rubber (EPDM), nitrile-butadiene rubber (NBR), butyl chloride rubber, and the like. Butyl chloride rubber is the most desirable in terms of resistance to ink. It is desirable to select an elastic body to be used so that a weight change rate of the elastic body to an ink-jet recording ink is 5% or less when it has been immersed in the recording liquid for about 300 hours.

If the hardness of a rubber element is too high, a great press force may be required to press the recording head face; if the rubber hardness is too low, a large deformation amount during pressing may make it difficult to keep airtightness. Therefore, a desired rubber hardness is in the range of 30 to 45 degrees.

The airtight elastic cap 1 may be one that singly keeps airtightness by a press force produced by the weight of the ink-jet recording head itself, or may be used as an airtightness keeping cap placed near a maintenance station of, e.g., the recording head within the ink-jet recording apparatus body. Also, in such cases, the airtight elastic cap of the present invention provides satisfactory airtightness and resistance to ink leak for the ink-jet recording head.

As in the above-described embodiment example, when using the ink-jet recording head, where the airtight elastic cap 1 is placed within the storage container, it is advisable to provide the airtight elastic cap body 2 with engagement parts 6*a*, 6*b*, 6*c*, and 6*d* respectively engaged with latching claws 36 (four in this embodiment example) as latching members, formed within the storage container by the injection molding method, and secure the airtight elastic cap 1 within the recording head housing part 31, as shown in FIG. 4. The above-described latching claws each have a catch for the engagement parts 6*a*, 6*b*, 6*c*, and 6*d* so that the airtight elastic cap is not easily disengaged from the recording head housing part 31 when the ink-jet recording head 40 is mounted or dismounted. As shown in FIG. 5, the latching claws 36 may be integrated with a holder 50, which is secured to the recording head housing part 31.

Figure 7:
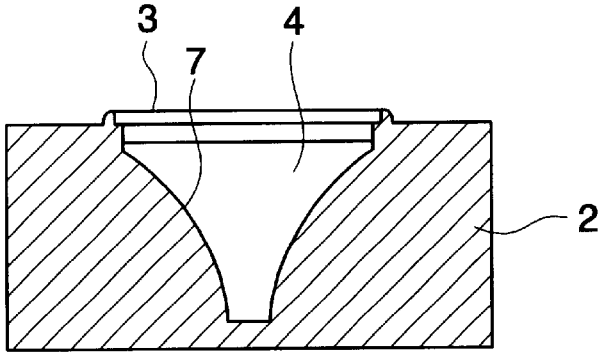
FIG. 7 is a longitudinal sectional view showing the structure of the airtight elastic cap according to one embodiment of the present invention.
Figure 8:
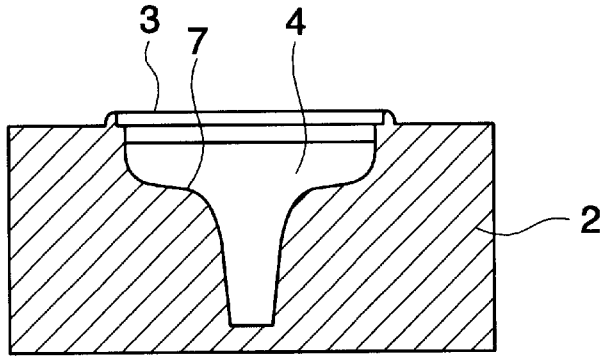
FIG. 8 is a longitudinal sectional view showing the structure of the airtight elastic cap according to one embodiment of the present invention.

As in an airtight elastic cap shown in a longitudinal sectional view of FIG. 7 or 8, if a first space 4 is defined by an inside wall face 7 having a convex area inside, the first space 4 can be formed into a shape resulting from integrating the first space and the second space by removing the boundary shown in FIG. 2. Thereby, the same effect as the airtight elastic cap of FIG. 2 can be obtained without providing a second space. As apparent from comparisons between FIGS. 2 and 7 or 8, the existence of a second space can be determined from the existence or absence of a boundary line protruding from the inside wall face.

An airtight elastic cap is structured so as to have a large clearance at the center thereof and in a lower portion thereof, whereby it is structured so as to be deeper only at the center of the cap than conventional caps. With this structure, the airtight elastic cap 1 is resistant to changes in atmospheric pressure and rarely suffers ink leak from a nozzle. The airtight elastic cap is structurally not thin in the wall thickness thereof and has high stiffness, ensuring steady capping. Also, the cap is constructionally simple and can be advantageously constructed from only one rubber part.

The entire disclosure of Japanese Patent Application No. 2000-26799 filed on Feb. 2, 2001 including specification, claims, drawings and abstract is incorporated herein by reference in its entirety.

What is claimed is:

1. An airtight elastic cap of an ink-jet recording head, the elastic cap comprising:

a single piece body;

only one inside space hollowed out of just one face of the body; and the hollowed out space having an inside wall, a portion of which defines a first space and another portion of the wall defining a second space positioned continuously to a center of the first space.

2. The airtight elastic cap according to claim 1, wherein the portion of the inside wall of the body defining the first space has inclined faces and the second space is defined by the another portion of the wall continuously to a proximity of a vertex formed by the inclined faces.

3. The airtight elastic cap according to claim 1, wherein the body has a rib abutting against the ink-jet recording head.

4. An ink-jet recording apparatus comprising the airtight elastic cap according to claim 1.

5. The cap of claim 1, wherein the second space is located at a bottom portion of the cap.

6. A storage container of an ink-jet recording head, the storage container comprising:

a container body that houses the ink-jet recording head; and an airtight elastic cap, placed within the container body, that abuts against and protects an ink emission face of the ink-jet recording head while the ink-jet recording is housed, the airtight elastic cap comprising a single piece cap body, only one inside space hollowed out of just one face of the cap body, the hollowed out space having an inside wall, a portion of the wall defining a first space and another portion of the wall defining a second space positioned continuously to a center of the first space.

7. The storage container of the ink-jet recording head according to claim 6, wherein the portion of the inside wall of the body defining the first space has inclined faces and the second space is defined by the another portion of the wall continuously to a proximity of a vertex formed by the inclined faces.

8. The storage container of the ink-jet recording head according to claim 6, wherein the cap body has a rib abutting against the ink-jet recording head.

9. The storage container according to claim 6, the storage container comprising a first container and a second container engaging with the first container, wherein the airtight elastic cap is placed within the first container and the second container has an elastic body for energizing the ink-jet recording head toward the airtight elastic cap.

10. The storage container according to claim 9, wherein:

the airtight elastic cap comprises a rubber element;

the hardness of the rubber element is in a range of 30 to 45 degrees; and a press force of the ink-jet recording head against the rubber element is in a range of 350±150 gf.

11. The storage container according to claim 10, wherein the rubber element is made of butyl chloride rubber.

12. A storage container of an ink-jet recording head, the storage container comprising:

a container body that houses the ink-jet recording head; and an airtight elastic cap, placed within the container body, that abuts against and protects an ink emission face of the ink-jet recording head while the ink-jet recording is housed, the airtight elastic cap comprising a cap body, and an inside wall provided inside of the cap body, a portion of the wall defining a first space and another portion of the wall defining a second space positioned continuously to a center of the first space;

the storage container comprising a first container and a second container engaging with the first container, wherein the airtight elastic cap is placed within the first container and the second container has an elastic body for energizing the ink-jet recording head toward the airtight elastic cap;

wherein the first container has a latching member for latching the airtight elastic cap.

13. The storage container according to claim 12, wherein the airtight elastic cap has an engagement part engaging with the latching members.

14. A storage container of an ink-jet recording head, the storage container comprising:

a container body that houses the ink-jet recording head; and an airtight elastic cap, placed within the container body, that abuts against and protects an ink emission face of the ink-jet recording head while the ink-jet recording is housed, the airtight elastic cap comprising a cap body, and an inside wall provided inside of the cap body, a portion of the wall defining a first space and another portion of the wall defining a second space positioned continuously to a center of the first space;

the storage container comprising a first container and a second container engaging with the first container, wherein the airtight elastic cap is placed within the first container and the second container has an elastic body for energizing the ink-jet recording head toward the airtight elastic cap;

wherein the first container has a rib for controlling a clearance or contact state between the ink-jet recording head and the airtight elastic cap.

15. An airtight elastic cap of an ink-jet recording head, the elastic cap comprising:

a single piece body;

only one inside space hollowed out of just one face of the body; and the hollowed out space having an inside wall having a convex region inside thereof and defining a first space.

16. An ink-jet recording apparatus comprising the airtight elastic cap according to claim 15.

17. A storage container of an ink-jet recording head, the storage container comprising:

a container body for housing the ink-jet recording head; and an airtight elastic cap, placed within the container body, that abuts against and protects an ink emission face of the ink-jet recording head while the ink-jet recording head is housed, wherein the airtight elastic cap comprises a single piece cap body, only one inside space hollowed out of just one face of the cap body, the hollowed out space having an inside wall, having a convex region and defining a first space.

18. An airtight cap of an ink-jet recording head, the cap comprising:

a single piece body;

only one inside space hollowed out of just one face of the body; and the hollowed out space having an inside wall, a portion of which defines a first space and another portion of the wall defining a second space positioned continuously to a part of the first space.

19. An ink-jet recording apparatus comprising the airtight cap according to claim 18.

20. A storage container of an ink-jet recording head, the storage container comprising:

a container body for housing the ink-jet recording head; and an airtight cap, placed within the container body, that abuts against and protects an ink emission face of the ink-jet recording head while the ink-jet recording head is housed, wherein the airtight cap comprises a single piece cap body, only one inside space hollowed out of just one face of the cap body, the hollowed out space having an inside wall, a portion of the wall defining a first space and another portion of the wall defining a second space positioned continuously to a part of the first space.

21. An airtight cap of an ink-jet recording head, the cap comprising:

a body including only one inside space hollowed out of just one face of the body, the hollowed out space having an inside wall, a portion of which defines a first space and another portion of the wall defining a second space positioned continuously to a part of the first space.

22. An ink-jet recording apparatus comprising the airtight cap according to claim 21.

23. A storage container of an ink-jet recording head, the storage container comprising:

a container body for housing the ink-jet recording head; and an airtight cap, placed within the container body, that abuts against and protects an ink emission face of the ink-jet recording head while the ink-jet recording head is housed in the container body, the airtight cap comprising a single piece cap body, only one inside space hollowed out of just one face of the cap body, the hollowed out space having an inside wall, including a first space and a second space provided continuously to a part of the first space.

24. An airtight cap of an ink-jet recording head, the cap comprising:

a single piece body;

only one inside space hollowed out of just one face of the body; and the hollowed out space having an inside wall having a convex region inside thereof and defining a first space.

25. An ink-jet recording apparatus comprising the airtight cap according to claim 24.

26. A storage container of an ink-jet recording head, the storage container comprising:

a container body for housing the ink-jet recording head; and an airtight cap, placed within the container body, that abuts against and protects an ink emission face of the ink-jet recording head while the ink-jet recording head is housed, the airtight cap comprising a single piece cap body, only one inside space hollowed out of just one face of the cap body, having a convex region inside thereof and defining a first space.

* * * * *